US005152420A

United States Patent [19]

Bird et al.

[11] Patent Number: 5,152,420

[45] Date of Patent: Oct. 6, 1992

[54] RECYCLE TRASH CONTAINER

[75] Inventors: David A. Bird, Akron; John L. Hradisky, Medina, both of Ohio

[73] Assignee: Rubbermaid Incorporated, Wooster, Ohio

[21] Appl. No.: 739,135

[22] Filed: Jul. 31, 1991

[51] Int. Cl.[5] ..... B65D 90/04

[52] U.S. Cl. ..... 220/600; 220/608; 220/623; 220/404; 220/500; 220/507; 220/908; 220/909

[58] Field of Search ..... 220/908, 909, 608, 623, 220/339, 575, 404, 500, 501, 507, 508, 509, 503, 513, 516, 517, 527, 553, 555, 600

[56] References Cited

U.S. PATENT DOCUMENTS

| | | | |
|---|---|---|---|
| 3,485,434 | 12/1969 | Donovan et al. | 220/608 X |
| 3,499,540 | 3/1970 | Huncovsky | 220/555 X |
| 3,658,233 | 4/1972 | Voytko | 220/908 X |
| 4,664,347 | 5/1987 | Brown et al. | 220/908 X |
| 4,676,431 | 6/1987 | Teske et al. | 220/908 X |
| 4,890,760 | 1/1990 | Nicoll, Sr. et al. | 220/908 X |
| 4,907,710 | 3/1990 | Bulkens | 220/909 X |
| 5,022,548 | 6/1991 | Stakis | 220/909 X |
| 5,036,999 | 8/1991 | Bitsch | 220/908 X |
| 5,050,762 | 9/1991 | Giorgi | 220/908 X |

OTHER PUBLICATIONS 2 page advertisement, Recyclist by MAB Designs, 741 Garyray Drive, North York Ont. Canada M9L 1R2; 1990.

1 page advertisement by Extrufix Inc., 11 Heritage Road, Markham, Ontario, Canada L3P 1M3; 1990.

1 page advertisement by Feeny Manufacturing Company; 1991.

*Primary Examiner*—Stephen Marcus
*Assistant Examiner*—Paul A. Schwarz
*Attorney, Agent, or Firm*—Renner, Kenner, Greive, Bobak, Taylor & Weber

[57] ABSTRACT

A container for holding cans (C) or the like includes a base container portion (11) and a cover (12). The base container (11) includes a bottom surface (13) with side walls (14, 15) and a rear wall (16) extending upwardly therefrom forming rims (20, 21) defining an open top for the base container (11). A front wall (17) also extends upwardly from the bottom surface (13) and includes a U-shaped door frame (18) formed at the top thereof. The bottom surface (13) is undulated to form peaks (29) with a valley (30) therebetween configured so as to neatly receive the cans (C). The cover (12) includes a top surface (33) having a downturned rim (34) resting on the rims (20, 21). A living hinge (36) connects top surface (33) to a door (37) which is received within door frame (18). Cans (C) passed laterally through door (37) are automatically stacked on the undulated bottom surface (13) of the base container (11).

15 Claims, 3 Drawing Sheets

RECYCLE TRASH CONTAINER

TECHNICAL FIELD

This invention relates to a trash container. More particularly, this invention relates to a trash container specifically designed for the collection of recyclable trash such as cans. Specifically, this invention relates to such a container which is of a size to fit conveniently under the sink or in like cabinets and yet efficiently hold the maximum amount of recyclable materials.

BACKGROUND ART

In view of the ecological emphasis on the recycling of trash materials, the need for separate containers to hold the same in a sorted environment has become prevalent. In an attempt to satisfy this need, many manufacturers have developed recycle container systems, that is, a plurality of containers which may stack with each other or which may be carried on a cart or the like, are provided so that the user may separate items such as glass, cans, recyclable paper, and non-recyclable items. Oftentimes these containers are color-coded to identify the type of trash they are to receive.

The problem with these systems is that the containers are usually quite large and either individually, and certainly as a system, are too large for use in some of the typical household environments for waste containers, such as under the sink or in small cabinets. Merely making the containers smaller would satisfy the space requirements but would result in the inefficient premature filling of the smaller containers resulting in the frequent need to empty the same into some other container. Such is particularly the case with items such as the conventional soda or beverage cans which, if merely dropped into a container, will be rather haphazardly positioned therein wasting a great deal of otherwise useable space.

DISCLOSURE OF THE INVENTION

It is thus a primary object of the present invention to provide a trash container which is of a size to fit within small confines and yet which will hold the maximum amount of trash therein.

It is another object of the present invention to provide a trash container, as above, which is particularly suited to meet ecological recycle needs.

It is a further object of the present invention to provide a trash container, as above, which is specifically designed to receive beverage cans and which is configured such that the cans are automatically, neatly stacked therein for maximum storage purposes.

It is an additional object of the present invention to provide a trash container, as above, which is adapted to receive and hold a plastic bag therein to carry the recyclable trash.

These and other objects of the present invention, as well as the advantages thereof over existing prior art forms, which will become apparent from the description to follow, are accomplished by the means hereinafter described and claimed.

In general, the container according to the present invention includes a base portion having a bottom surface with a front wall, a rear wall, and side walls extending upwardly therefrom to define an open top. The bottom surface is undulated to form a plurality of peaks with a valley between each peak. In this manner, cans or similar items can be properly positioned within the container.

A preferred exemplary recycle trash container incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
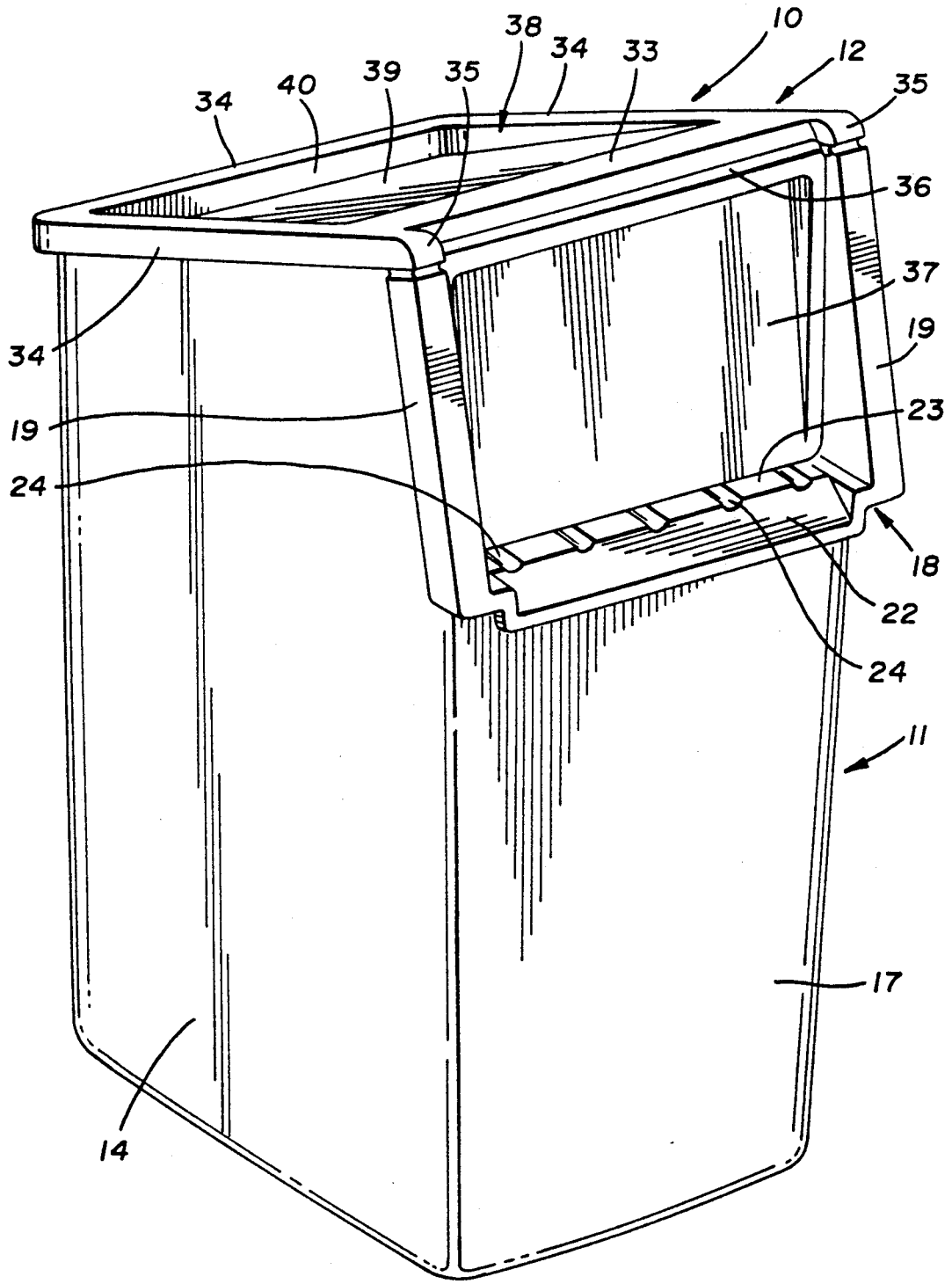
FIG. 1 is a perspective view of a recycle trash container made in accordance with the concepts of the present invention.

A container according to the concepts of the present invention is indicated generally by the numeral 10 and includes a base, trash-receiving portion, indicated generally by the numeral 11, and may also include a cover and door assembly indicated generally by the numeral 12. Base portion 11, which is preferably molded of a plastic material such as polyethylene, includes a bottom surface, indicated generally by the numeral 13, side walls 14 and 15, a rear wall 16 and a front wall 17. Walls 14, 15, 16 and 17 all extend generally vertically upwardly from the periphery of bottom surface 13, preferably being at a slight draft angle thereto for ease of molding and to permit the nesting of container 10 in a like container for shipment and retail display purposes.

As shown, front wall 17 is shorter than rear wall 16 and has a U-shaped door frame, generally indicated by the numeral 18, positioned at the top thereof. Frame 18 includes upwardly projecting corner posts 19 which extend higher than rear wall 16. Side walls 14 and 15 extend upwardly to the top of rear wall 16 and to the top of corner posts 19 terminating as rearwardly inclined side rims 20. A rear rim 21 at the top of rear wall 16 and side rims 20 together with front wall 17 define an open top for container 10, with frame 18 defining a partially open front. Side rims 20 and rear rim 21 can also provide a gripping handle-like surface for carrying base portion 11, as desired.

The lower branch of U-shaped frame 18, which spans between corner posts 19, is configured as having a downwardly, forwardly inclined handle portion 22 and a ramp portion 23 which is somewhat downwardly, rearwardly inclined into base portion 11. Ramp portion 23 may be provided with slots 24 molded therein. Such slots not only provide an adornment to base portion 11, but also they serve as a visual reminder to the user as to the preferred manner of placing a can in base portion 11 as will be hereinafter described.

Rear wall 16 and front wall 17 may each also be provided with at least one and preferably a plurality of downwardly directed stacking ribs 25 and 26, respectively, which extend downwardly along rear wall 16 and front wall 17, respectively. Stacking ribs 25 and 26 are designed to rest on the upper rear rim 21 and front ramp 23, respectively, of a like container when base portion 11 is nested within the base portion of the like container to avoid jamming of the products.

Bottom surface 13 includes a raised pedestal indicated generally by the numeral 27 and positioned generally centrally of bottom surface 13 to define a continuous peripheral foot 28 for container 10. Pedestal 27 has an undulating upper surface defined by a plurality of peaks 29 with a valley 30 between each peak 29. As shown, the undulations run from front to back with peaks 29 and valleys 30 therebetween running laterally from side to side of base portion 11, that is, generally parallel to ramp 23 of door frame 18. The number of peaks 29 and valleys 30 is unimportant to this invention and while two peaks 29 with a valley 30 therebetween is shown by way of example, it is contemplated that base portion 11 could be made deeper, from front to back, and in that instance additional peaks 29 and valleys 30 would be provided. Thus, no matter what the size of pedestal 27, its surface is undulated as described throughout. Moreover, irrespective of how many peaks 29 are provided, pedestal 27 is formed with a front partial valley 31 adjacent front wall 17 and a rear partial valley 32 adjacent rear wall 16 which are almost flat surfaces adjacent to the end peaks 29.

Figure 2:
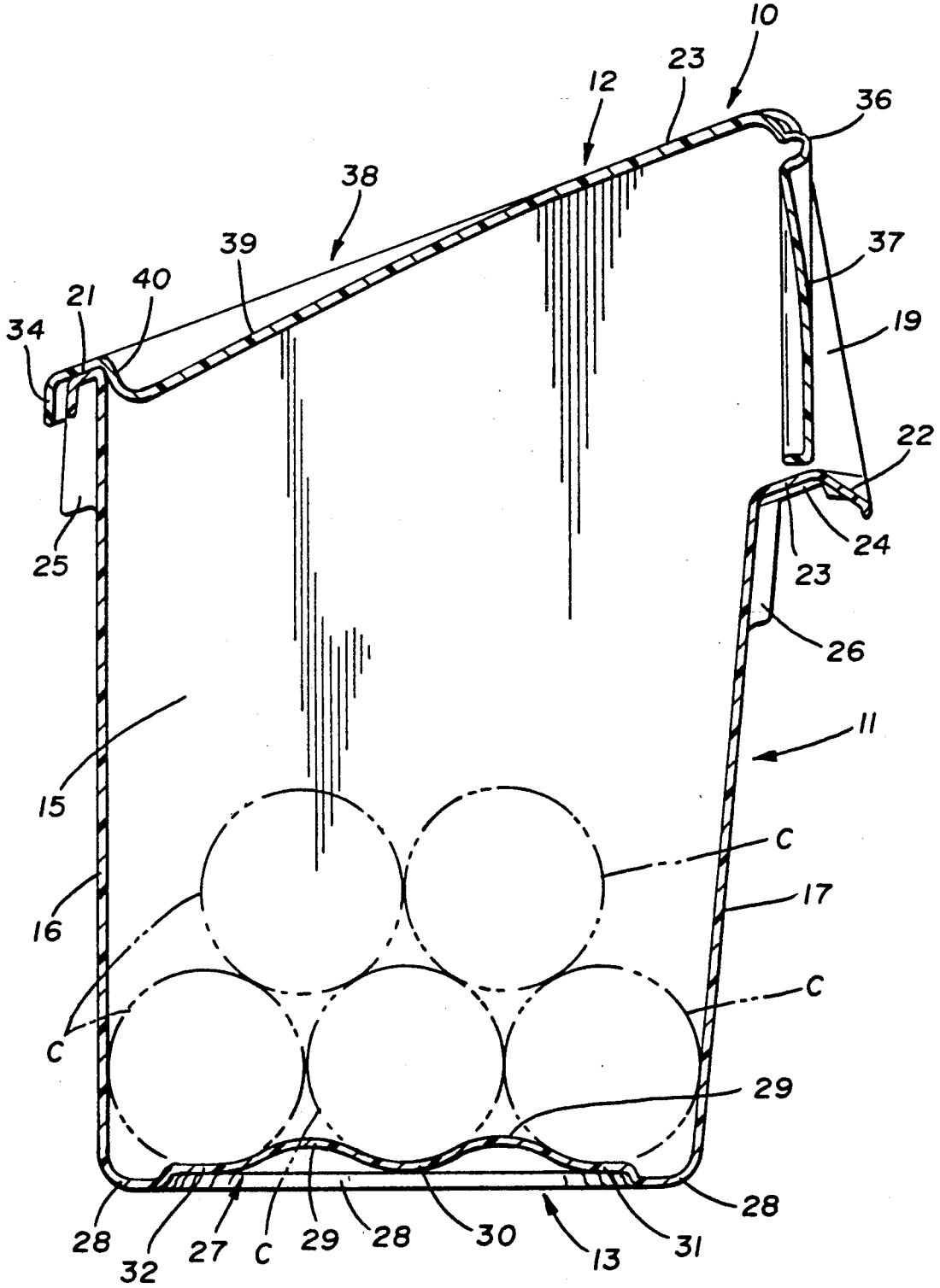
FIG. 2 is a vertical sectional view of the recycle trash container of FIG. 1 showing conventional beverage cans positioned therein.

As shown in FIG. 2, the primary purpose of undulated pedestal 27 is to neatly receive recyclable cans C such as conventional soda or other beverage cans. As such, it is important that the arc or curvature of each valley 30 generally corresponds in size to the arc or curvature provided by the radius of curvature of the cans C to be contained in base portion 11. Thus, when a can C is rolled on its side down inclined ramp 23 it will be guided into position either solely within a valley 30 and will be confined between front partial valley 31 and front wall 17 or rear partial valley 32 and rear wall 16. When the bottom of base portion 11 is completely filled with cans C, these cans form the peaks and valleys for the next row of cans such that the next cans positioned in base portion 11 will stack as shown in FIG. 2. This stacking process continues until base container 11 is filled with the maximum number of cans C.

Figure 3:
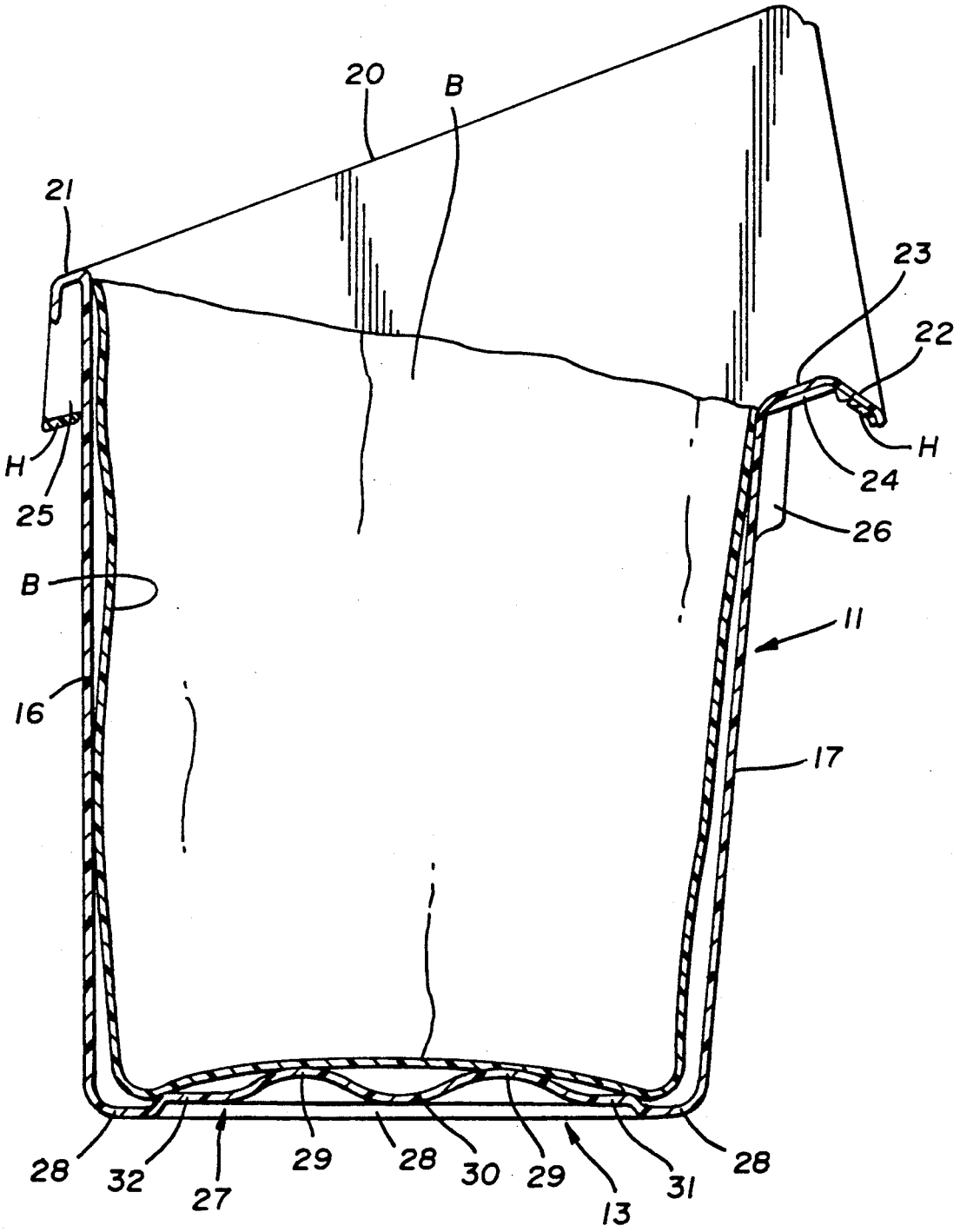
FIG. 3 is a vertical sectional view similar to FIG. 2 but not showing the cover and showing a conventional plastic bag in the container.

As shown in FIG. 3, base container portion 11 is also readily adaptable to receiving a bag B therein. One type of conventional bag B for which base portion 11 is particularly suited has come to be known as a plastic T-shirt bag. Such bags have handles H which may be received around rear stacking rib 25 and around front handle portion 22, with the plastic bag portion being draped within the open-topped base portion 11 to receive the recycle trash, as may be desired.

As previously indicated, container 10 may also be provided with a cover 12 to close the open top of base portion 11. A suitable and preferred cover 12 is shown in FIGS. 1 and 2 and includes a top surface 33 and a downturned rim 34 on the periphery of the sides and rear thereof. Downturned rim 34 is thus adapted to rest on rear upper rim 21 of rear wall 16 of base portion 11 and on side rims 20 as well. The front of downturned rim 34 on the sides of top surface 33 is provided with small extensions 35 which rest on corner posts 19 of door frame 18.

Cover 12 is preferably molded of a polypropylene material and spanning between extensions 35 at the front of top surface 33 is a conventional "living" hinge 36, known in the art as a hinge formed by the continuous integral junction of a material capable of providing an essentially unlimited flexures of the hinge—a typical characteristic of polypropylene. Hinge 36 connects top surface 33 to a downwardly directed door 37 which effectively fills the void within U-shaped door frame 18 to close the partially open front of base portion 11 previously described. Door 37 thus extends downwardly to a position just above and adjacent to ramp portion 23 of frame 18.

As shown, because cover 12 sits on rearwardly inclined side rims 20 of base portion 11, top surface 33 is likewise rearwardly inclined. Moreover, top surface 33 is provided with a recess generally indicated by the numeral 38 which has a bottom surface 39 that is even more rearwardly inclined than top surface 33. Recess 38 terminates near the rear of top surface 33 as a rear confining wall 40. Recess 38 not only aesthetically complements the overall configuration of cover 12 but also provides a location for the deposit and confinement of small items that might be used in conjunction with container 10 such as a supply of bags B, conventional bag twist ties, or the like.

Door 37 not only closes container 10 to confine unsightly trash and potential odors, but also, in view of its living hinge 36 mount, serves to assist the user in the proper placement of cans C in base container 11. If the door were, for example, to be supported rather loosely by a conventional hinge, the lack of resistance to opening might allow the user to push a can therethrough with its top or bottom first thereby orienting it opposite to the direction of the undulating surface of pedestal 27. The resistance of the living hinge 36, however, makes it less likely that the user will open door 37 wide enough to permit the misoriented can C to pass therethrough. Rather, the user will align the can laterally on ramp surface 23 and push it through door 37, the resiliency of which will guide can C to its proper location in base portion 11 and otherwise control the rate of entry of can C into base portion 11. Thus, in this manner, cover 12 cooperates with base portion 11 for the efficient stacking of cans C therein.

It should thus be evident that a container constructed ad described hereinabove accomplishes the objects of the present invention and otherwise substantially improves the art.

We claim:

1. A container for holding cans or the like comprising a bottom surface; a front wall, a rear wall, and side walls extending upwardly from said bottom surface to define an open top; said bottom surface being undulated to form a plurality of peaks with a valley between each peak; each of said peaks and valleys extending laterally from side to side on said bottom surface with each of said valleys having a curved surface conforming to the curvature of a can so that cans may be readily positioned in said valleys of said bottom surface of the container; there being a partial valley formed between a first of said peaks and said front wall and a partial valley formed between a last of said peak and said rear wall so that a can may be positioned in said partial valley between said first of said peaks and said front wall and in said partial valley between said last of said peaks and said rear wall.

2. A container according to claim 1 wherein said bottom surface includes a raised pedestal defining a peripheral foot in said bottom surface.

3. A container according to claim 1 further comprising a cover to close said open top and including a top surface and a door hingedly depending from said top surface.

4. A container according to claim 1 further comprising a handle near the top of said front wall.

5. A container according to claim 1 further comprising means to attach a bag to said front wall and said rear wall.

6. A container according to claim 1 further comprising a rim at the top of said side walls and said rear wall and an open door frame defined at the top of said front wall.

7. A container according to claim 6 further comprising a cover having a top surface resting on said rim and a door received in said door frame.

8. A container according to claim 7, said cover being made of a polypropylene material and further comprising living hinge means connecting said top surface to said door.

9. A container according to claim 7 said cover further including a downturned rim on said top surface, said downturned rim resting on said rim of said side walls and said rear wall.

10. A container according to claim 7 said cover further comprising a recess in said top surface.

11. A container for holding cans or the like comprising a bottom surface including a raised pedestal defining a peripheral foot in said bottom surface; a front wall, a rear wall, and side walls extending upwardly from said bottom surface to define an open top; said bottom surface being undulated to form a plurality of peaks with a valley between each peak; said peaks and valleys extending laterally from side to side on said pedestal whereby cans may be positioned in said valleys in said bottom surface of the container.

12. A container according to claim 11 wherein said undulated bottom surface includes a partial valley formed between a first of said peaks and said front wall and a partial valley formed between a last of said peaks and said rear wall.

13. A container for holding cans or the like comprising a bottom surface; a front wall, a rear wall, and side walls extending upwardly from said bottom surface to define an open top; said front wall being shorter than said rear wall and said side walls thereby forming an opening therein, and an inclined ramp formed on the top of said front wall said ramp extending outwardly from said front wall; said bottom surface being undulated to form a plurality of peaks with a valley between each peak for positioning cans in the container.

14. A container for holding cans or the like comprising a bottom surface; a front wall, a rear wall, and side walls extending upwardly from said bottom surface to define an open top; a handle formed near the top of said front wall; rib members extending downwardly along the outside of said rear wall; said handle and said rib members together forming a means to attach a bag to said front wall and said rear wall; said bottom surface being undulated to form a plurality of peaks with a valley between each peak for positioning cans in the container.

15. A container for holding cans or the like comprising a bottom surface; a front wall, a rear wall, and side walls extending upwardly from said bottom surface to define an open top; a rim at the top of said side walls and said rear wall and an open door frame defined at the top of said front wall; a cover having a top surface resting on said rim and a door received in said door frame; said bottom surface being undulated to form a plurality of peaks with a valley between each peak for positioning cans in the container; said undulated bottom surface including a partial valley formed between a first said peak and said front wall and a partial valley formed between a last said peak and said rear wall.

* * * * *